United States Patent [19]

Dent

[11] Patent Number: 4,524,809

[45] Date of Patent: Jun. 25, 1985

[54] FITMENTS FOR CONTAINERS FROM WHICH LIQUID IS INTENDED TO BE WITHDRAWN BY A HOLLOW NEEDLE OR TUBE

[75] Inventor: Hugh R. Dent, Chippenham, England

[73] Assignee: Sterimatic Holdings Limited, Tortola, V.I.

[21] Appl. No.: 496,488

[22] Filed: May 17, 1983

[30] Foreign Application Priority Data

Jan. 29, 1983 [GB] United Kingdom ..... 8302481

[51] Int. Cl.[3] ..... B65B 3/04

[52] U.S. Cl. ..... 141/1; 141/18; 141/98; 141/329; 215/251; 604/415

[58] Field of Search ..... 215/251; 141/19, 329, 141/330, 90, 1-12, 20-29, 37-66, 98; 604/415

[56] References Cited

U.S. PATENT DOCUMENTS

| | | | |
|---|---|---|---|
| 1,189,465 | 7/1916 | Mayo | 604/415 |
| 3,871,545 | 3/1975 | Bereziat | 215/251 |
| 4,011,961 | 3/1977 | Widen et al. | 604/415 |

FOREIGN PATENT DOCUMENTS

| | | | |
|---|---|---|---|
| 209183 | 2/1957 | Australia | 215/247 |

*Primary Examiner*—Houston S. Bell, Jr.

*Attorney, Agent, or Firm*—Young & Thompson

[57] ABSTRACT

A bottle containing injection liquid from which liquid is intended to be withdrawn by inserting a hollow needle into the bottle is provided with a fitment for sterilizing the needle as it is introduced into the bottle. The fitment comprises connector attached to the bottle and a detachable cap having a body part which is received within a tubular part of the connector. The cap is in the form of an enclosure containing a body of absorbent material impregnated with sterilizing substance and incorporating an end wall having an integral removable portion separable therefrom by rupturing the material of the end wall so as to form an aperture in the end wall through which the point of the needle may pass into the enclosure. The point of the needle is thereby sterilized as it is moved through the enclosure into the bottle to withdraw liquid therefrom and is sterilized for a second time on withdrawal from the fitment. After use the cap may be replaced by a cap containing fresh sterilizing substance, and the sterilizing substance is prevented from being contaminated from outside, until it is to be used, by the removable portion.

16 Claims, 3 Drawing Figures

FITMENTS FOR CONTAINERS FROM WHICH LIQUID IS INTENDED TO BE WITHDRAWN BY A HOLLOW NEEDLE OR TUBE

BACKGROUND OF THE INVENTION

This invention relates to fitments for containers from which liquid is intended to be withdrawn by a hollow needle or tube. The liquid may, for example, be an injection liquid which is to be injected by means of the needle.

Routine multiple injections are given by farmers to suppress the effects of intestinal and other parasitic worms in cattle, sheep and pigs and for other purposes. With such multiple injections it is not usual to sterilise the site of injection either before or after the injection, and the same needle is used to inject a large number of animals. Where the injection dose is withdrawn directly from a bottle containing injection liquid by inserting the needle into the bottle, the unsterilised needle may contaminate the liquid in the bottle. Thus, where a number of doses are withdrawn from the same bottle, there is a significant chance of the site of injection becoming infected leading to an abscess. Each time the animal is injected it increases the risk of rejection of the carcass for human consumption due to the presence of abscesses.

U.K. Patent Specification No. 2,091,229A describes and claims a fitment for a container from which liquid is intended to be withdrawn by inserting a hollow needle or tube into the container, the fitment being in the form of a cap including a closed chamber within which sterilising means are disposed and means for attaching the cap to the container such that the needle or tube may be passed through the chamber in the cap in order to withdraw liquid from the container and the needle or tube is sterilised by the sterilising means as it passes through the chamber. Such a fitment serves to prevent contamination of the liquid in the container by the needle.

It is an object of this invention to provide a generally improved fitment for a container from which liquid is intended to be withdrawn by inserting a hollow needle or tube into the container.

SUMMARY OF THE INVENTION

According to the invention there is provided a fitment for a container from which liquid is intended to be withdrawn by inserting a hollow needle or tube into the container, the fitment being provided to sterilise the needle or tube as it is introduced into the container to withdraw liquid therefrom, and comprising an enclosure incorporating means for sterilising the needle or tube as it is moved therethrough, the enclosure having an end wall which is adapted to have an integral removable portion separated therefrom by rupturing the material of the end wall so as to form an aperture in the end wall through which the point of the needle or tube may pass into the enclosure.

Whilst the word "sterilising" is used in this specification in the sense of killing micro-organisms, such as bacteria or viruses, it should be understood that it is not essential that all micro-organisms are killed, that is to say that the needle or tube is rendered absolutely sterile. The sterilising means may, for example, comprise a sterilising substance in the form of a liquid, gel or powder.

The sterilising means is prevented from being contaminated from outside by the removable portion which may be separated from the remainder of the end wall when it is required to withdraw liquid from the container by inserting the needle or tube into the container by way of the sterilising means.

The fitment preferably includes a connector which is adapted to be connected to the container, and a cap which incorporates the enclosure and is adapted to be easily attachable to, and detachable from, the connector, for example by means of an interference fit therebetween. This provides ease of replacement of the cap by a cap incorporating fresh sterilising means.

The connector may comprise a tubular part within which a correspondingly shaped body part of the cap is intended to be received. In addition it may comprise an inwardly extending lip for engaging under a shoulder on the container in order to connect the connector to the container. Where the liquid is to be withdrawn by a needle, the fitment may be fitted over a closure member of the container. Thus, if the closure member is of the conventional self-sealing type, the needle may pass through the closure member after passing through the sterilising means within the enclosure and the closure member will automatically reseal the container on withdrawal of the needle. The connector may include a cross wall having an aperture extending therethrough for the passage of the needle or tube.

The removable portion is preferably attached to the remainder of the end wall by a substantially annular weakened region which is adapted to be ruptured in order to separate the removable portion. In a preferred embodiment of the invention the removable portion is adapted to be grasped manually and to be separated from the remainder of the end wall by twisting. For example the removable portion may be attached to the remainder of the end wall by a thin-walled annular neck constituting said weakened region. When this neck is ruptured by twisting the removable portion the removable portion will become separated from the remainder of the end wall and may be discarded leaving an aperture in the end wall for the needle or tube.

A wall of the enclosure may have a weakened portion which may be perforated by the needle or tube to enable the needle or tube to be moved therethrough. The enclosure may be formed by a cup-shaped body part and a top part connected to the body part so as to close off the container. To this end the body part may be formed with an outwardly projecting flange for engaging within an annular recess in an inner surface of the top part so as to provide a snap coupling between the two parts. The enclosure may be formed with one or more outwardly extending winged flanges thereon as an aid to detaching the cap from the connector. The sterilising means may be constituted by a body of absorbent material impregnated with sterilising substance within the enclosure.

The invention also provides a liquid container fitted with such a fitment, the fitment preferably being fitted over a self-sealing closure member of the container.

The invention further provides a method of withdrawing liquid from a container using a hollow needle or tube and a fitment comprising an enclosure incorporating sterilising means attached to the container, the method comprising separating an integral removable portion from an end wall of the enclosure by rupturing the material of the end wall so as to form an aperture in the end wall, passing the point of the needle or tube into the enclosure by way of the aperture so formed, moving the point of the needle or tube through the sterilising means and into the liquid in the container, and withdrawing liquid from the container by drawing it up the needle or tube.

BRIEF DESCRIPTION OF THE DRAWINGS

In order that the invention may be more fully understood, a preferred embodiment of the invention will now be described, by way of example, with reference to the accompanying drawings, in which.

DETAILED DESCRIPTION OF THE DRAWINGS

Figure 1:
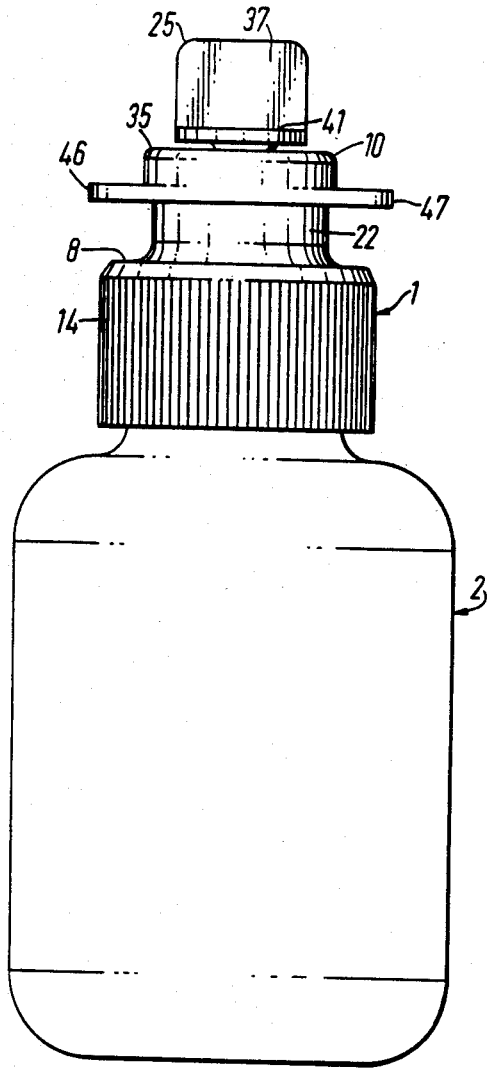
FIG. 1 is a view from one side of an injection liquid bottle fitted with a fitment in accordance with the invention.

The sterilising fitment 1 is shown fitted to a 50 ml. glass bottle 2 containing injection liquid and provided with a self-sealing closure member 4 of a known type. The closure member 4 comprises a rubber self-sealing element (not shown) and a metal ring 6 which co-operates with an annular flange (not shown) provided on the bottle 2 to clamp the self-sealing element on to the bottle 2.

The fitment 1 is made of polypropylene and comprises a connector 8 connecting the fitment 1 to the bottle 2 and a cap 10 which is easily attachable to, and detachable from, the connector 8. The connector 8 is attached to the bottle 2 by an inwardly extending annular lip 12 at the bottom of a sleeve part 14 surrounding the ring 6 of the closure member 4. The lip 12 engages under a shoulder 16 formed by the ring 6. The lip 12 may be formed after the connector 8 has been fitted over the closure member 4, for example by means of a heat treatment. Alternatively the lip 12 may be preformed, and the sleeve part 14 of the connector 8 may be deformable to enable the lip 12 to fit over the closure member 4 and to snap in under the ring 6. In addition the lip 12 may be provided with a ramp surface to enable it to fit over the closure member 4 more easily.

The connector 8 also includes a cross wall 18 having an aperture 20 extending therethrough and engaging the top of the closure member 4, and an upwardly extending tubular part 22 within which the cap 10 is received. The outer surface of the sleeve part 14 of the connector 8 is milled so as to enable the connector 8 to be held firmly against twisting as will be described below.

Figure 2:
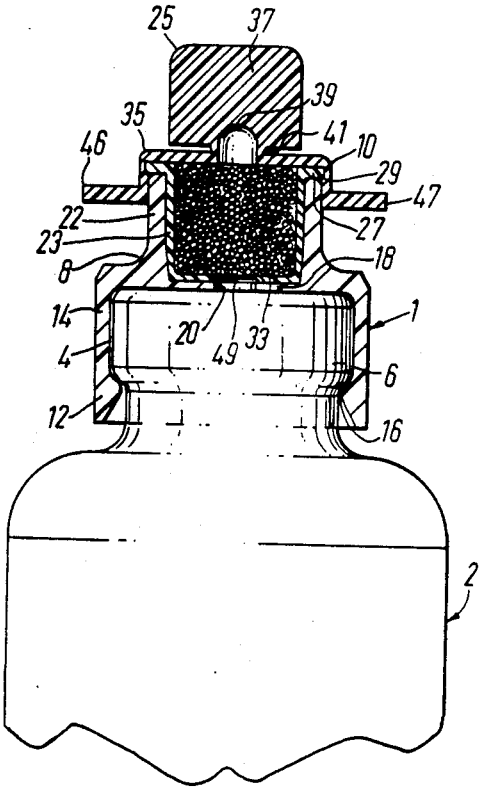
FIG. 2 is a view of the top of the bottle with the fitment being shown in vertical section.
Figure 3:
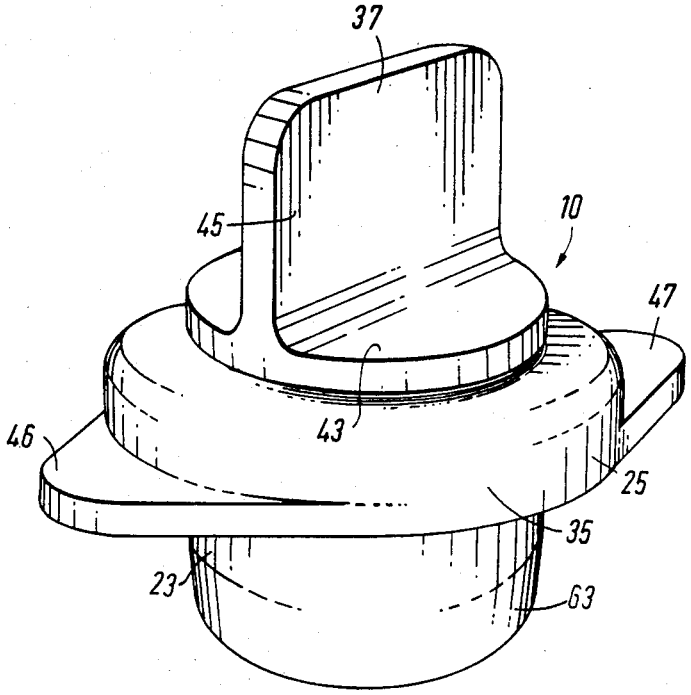
FIG. 3 is a perspective view of a part of the fitment.

The cap 10, which is shown on an enlarged scale in FIG. 3, is formed by injection moulding in two parts, namely a cup-shaped body part 23 and a top part 25. As shown in FIG. 2, the rim of the body part 23 is formed with an outwardly projecting flange 27 for engaging within an annular recess 29 in the inner surface of the top part 25 so as to provide a snap coupling between the two parts 23, 25 which together provide an enclosure for a sponge 33 impregnated with a sterilising liquid. The parts 23 and 25 are connected together permanently by sonic welding.

Referring to FIG. 3, the top part 25 of the cap 10 comprises a dish-shaped end wall 35 having a twist-off portion 37 attached thereto. A recess 39 extends through the end wall 35 into the twist-off portion 37 and is surrounded by a thin-walled annular neck 41 connecting the twist-off portion 37 to the end wall 35. The twist-off portion 37 is constituted by a circular disc 43 integrally formed with an upstanding tab 45 which may be grasped between the finger and thumb in order to twist the twist-off portion 37 in relation to the remainder of the cap 10 and to thereby separate the twist-off portion 37 from the end wall 35 at the neck 41. The end wall 35 is provided with outwardly extending winged flanges 46 and 47 for ease in fitting the cap 10 to, and removing it from, the remainder of the fitment.

The bottom wall of the body part 23 is provided with a weakened region 49 opposite the recess 39 through the end wall 35 so that this region 49 may be perforated by a needle. In addition the outer wall of the body part 23 is tapered at 63 (see FIG. 3) in order to ease fitting of the body part 23 of the cap 10 into the tubular part 22 of the connector 8.

In order to withdraw a dose of injection liquid from the bottle 2, the twist-off portion 37 is twisted in relation to the remainder of the fitment 1 whilst holding the milled sleeve part 14 of the fitment 1 and, if necessary, one of the flanges 46, 47 against rotation. This causes the thin-walled annular neck 41 to be ruptured and the twist-off portion 37 to be separated from the end wall 35 leaving a small aperture in the centre of the end wall 35. The twist-off portion is then discarded. The point of the needle of an injection gun, for example, is then passed through the aperture into the enclosure containing the sponge 33 impregnated with sterilising liquid and is caused to perforate first the weakened region 49 of the body part 23 and then the self-sealing element of the closure member 4 prior to being introduced into the injection liquid within the bottle 2. After the appropriate dose has been taken up, the needle may be withdrawn and the bottle 2 will be automatically resealed by the self-sealing element, thus preventing contamination of the liquid remaining within the bottle 2 from outside.

As the needle passes through the sponge 33 within the enclosure it is coated with sterilising liquid from the sponge 33. Thus the needle is sterilised as it is introduced into the bottle 2 so as to prevent contamination of the liquid 3 by the needle, and is sterilised for a second time on being withdrawn from the bottle 2 so that no further sterilisation of needle is required prior to an injection being effected.

When the sponge 33 within the cap 10 has become contaminated after a number of doses have been withdrawn or due to the fact that a long period of time has elapsed since the first dose was taken, the cap 10 may be pulled out of the tubular part 22 of the fitment and discarded, and a fresh cap 10 fitted into the tubular part 22. Thus a considerable number of doses may be withdrawn from the bottle 2 over a long period of time, with the cap 10 being replaced as required, without danger of the liquid within the bottle 2 becoming contaminated.

Whilst the above description has been given with reference to the withdrawal of injection liquid from a bottle by a hollow needle prior to an injection being performed with the needle, it should be understood that a similar fitment may be provided on a container for a liquid, such as glucose, which is to be introduced directly into a patient's blood supply. In this case, a needle at one end of a flexible tube is passed through the fitment into the container, a further needle at the other end of the flexible tube being inserted into the patient's arm. The fitment may also be used in applications where a liquid is to be withdrawn from a container by a thin tube. In this case the container will not generally be provided with a self-sealing closure member, but will be directly sealed by the sterilising cap.

Finally various modifications may be made to the fitment described with reference to the drawings without departing from the scope of the invention. For example, the outer surface of the body part 23 may be provided with a two-start screwthread comprising two separate thread portions each of which extends slightly more than half the way round the periphery of the body part 23, the thread portions being arranged relative to one another so that they overlap at both ends, and the inner surface of the tubular part 22 may be provided with a complementary screwthread with which the external screwthread on the body part 23 co-operates when the cap 10 is fitted to the remainder of the fitment 1.

In a modification of the above described fitment, the lip 12 of the connector 8 is replaced by four equiangularly spaced internal projections engaging under the shoulder 16 formed by the ring 6 and each provided with a respective ramp surface enabling the sleeve part 14 to fit over the closure member 4 more easily. In addition the sleeve part 14 is lengthened so as to extend below the shoulder 16 and has two outwardly extending winged flanges formed at its bottom as an aid to removing the connector 8 from the bottle 2.

I claim:

1. A fitment for a container from which liquid is intended to be withdrawn by inserting a hollow needle or tube into the container, the fitment being provided to sterilise the needle or tube as it is introduced into the container to withdraw liquid therefrom, which fitment comprises a sleeve, means at one end of the sleeve for attaching the sleeve to the container such that the sleeve surrounds an opening in the container and so that the point of the needle or tube may be passed into the container through the sleeve, and wall means closing off the other end of the sleeve and defining an enclosure incorporating means for sterilising the point of the needle or tube as it is moved therethrough, the enclosure having an end wall facing outwardly of the sleeve and having an integral removable portion separable therefrom by rupturing the material of the end wall so as to form an aperture in the end wall through which the point of the needle or tube may pass into the enclosure and hence into the container after sterilisation by the sterilising means.

2. A fitment for a container from which liquid is intended to be withdrawn by inserting a hollow needle or tube into the container, the fitment being provided to sterilise the needle or tube as it is introduced into the container to withdraw liquid therefrom, which fitment comprises a sleeve, means at one end of the sleeve for attaching the sleeve to the container such that the sleeve surrounds an opening in the container and so that the point of the needle or tube may be passed into the container through the sleeve, and a sterilising cap which is detachably connectable to the other end of the sleeve so as to close off said other end, the cap incorporating means for sterilising the point of the needle or tube as it is moved therethrough, whereby the point of the needle or tube may be sterilised by passing it through the cap into the sleeve before introducing it into the container.

3. A fitment according to claim 2, wherein the cap is attached to the sleeve by means of an interference fit therebetween.

4. A fitment according to claim 2, wherein the sleeve comprises a tubular part within which a correspondingly shaped body part of the cap is received.

5. A fitment according to claim 1, wherein the sleeve comprises an inwardly extending lip for engaging under a shoulder on the container in order to connect the sleeve to the container.

6. A fitment according to claim 1, wherein the removable portion is attached to the remainder of the end wall by a substantially annular weakened region which is rupturable in order to separate the removable portion.

7. A fitment according to claim 6, wherein the removable portion is attached to the remainder of the end wall by a thin-walled annular neck constituting said weakened region and is separable from the remainder of the end wall by twisting in order to ruputre the neck.

8. A fitment according to claim 1, wherein the wall means includes a further wall facing inwardly of the sleeve and having a weakened portion which may be perforated by the needle or tube to enable the needle or tube to be moved therethrough.

9. A fitment according to claim 1, wherein the wall means is in the form of a cap which incorporates the enclosure and is easily attachable to, and detachable from, the connector.

10. A fitment according to claim 2, wherein the cap is formed by a cup-shaped body part and a top part connected to the body part by an outwardly projecting flange on the body part engaging within an annular recess in an inner surface of the top part so as to provide a snap coupling between the two parts.

11. A fitment according to claim 2, wherein the cap is formed with one or more outwardly extending winged flanges thereon as an aid to detaching the cap from the sleeve.

12. A fitment according to claim 1, wherein the sterilising means is constituted by a body of absorbent material impregnated with sterilising substance within the enclosure.

13. A method of withdrawing liquid from a container using a hollow needle or tube and a fitment comprising an enclosure incorporating sterilising means attached to the container, the method comprising separating an integral removable portion from an end wall of the enclosure by rupturing the material of the end wall so as to form an aperture in the end wall, passing the point of the needle or tube into the enclosure by way of the aperture so formed, moving the point of the needle or tube through the sterilising means and into the liquid in the container, and withdrawing liquid from the container by drawing it up the needle or tube, whereby the point of the needle or tube is sterilised by the sterilising means before being introduced into the liquid in the container.

14. A fitment for a container from which liquid is intended to be withdrawn by inserting a hollow needle or tube into the container, with the object of sterilising the needle or tube as it is introduced into the container to withdraw liquid therefrom, which fitment comprises a sleeve, means at one end of the sleeve for attaching the sleeve to the container such that the sleeve forms an upstanding rim on the container which surrounds an opening in the container and so that the point of the needle or tube may be passed into the container through the sleeve, and means at the other end of the sleeve for detachably accommodating a sterilising cap for closing off said other end of the sleeve and sterilising the point of the needle or tube as it is moved through the cap into the sleeve before being introduced into the container.

15. A fitment according to claim 14, wherein said one end of the sleeve is of greater diameter than said other end and is separated therefrom by a shoulder, whereby said one end of the sleeve may be fitted over an upper portion of the container.

16. A fitment according to claim 14, wherein the sleeve comprises an inwardly extending lip for engaging under a shoulder on the container in order to connect the sleeve to the container.

* * * * *